US006250970B1

(12) United States Patent
Key et al.

(10) Patent No.: US 6,250,970 B1
(45) Date of Patent: Jun. 26, 2001

(54) ANGLED IDC LAMP SOCKET ASSEMBLY

(75) Inventors: Edward H. Key, Hershey; Steven M. Boyd; Ronald E. Thomas, both of Warren; Richard P. Walker, Saegertown, all of PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/548,508

(22) Filed: Apr. 13, 2000

Related U.S. Application Data

(60) Provisional application No. 60/137,554, filed on Jun. 4, 1999.

(51) Int. Cl.[7] ..... H01R 24/00

(52) U.S. Cl. ..... 439/699.2; 439/854

(58) Field of Search ..... 439/699.2, 699.1, 439/619, 419, 404–408, 356, 854, 752

(56) References Cited

U.S. PATENT DOCUMENTS 5,197,187 3/1993 Thomas ..... 29/863
5,397,251 * 3/1995 Kaminski ..... 439/620
5,823,816 10/1998 Uchida et al. ..... 439/419
5,954,541 * 9/1999 Ozai et al. ..... 439/608
5,971,814 * 10/1999 Boyd et al. ..... 439/699.2

FOREIGN PATENT DOCUMENTS 2 768 864 9/1997 (FR) .
2 176 663A 12/1986 (GB) .

* cited by examiner

*Primary Examiner*—Brian Sircus
*Assistant Examiner*—Son V. Nguyen
(74) *Attorney, Agent, or Firm*—William H. McNeill

(57) ABSTRACT

An angled lamp socket includes a body and a housing. The body contains therein opposing lamp retaining clips and a plurality of IDC contacts. The housing contains a plurality of holes to receive wire leads. The housing also contains a housing disc. The bottom portion of the IDC contacts are connected electrically to the wire leads and the top portion of the IDC contacts are connected to the lamp. When a lamp is inserted into the socket body, the horizontal axis of the lamp will extend at an angle in relation to the wire leads. In a preferred embodiment, such an angle is 90° thereby providing a right angle lamp socket.

3 Claims, 9 Drawing Sheets

ANGLED IDC LAMP SOCKET ASSEMBLY

CROSS REFERENCE TO RELATED APPLICATIONS

This application claims priority from Provisional Application Ser. No. 60/137,554 filed Jun. 4, 1999.

TECHNICAL FIELD

The present invention relates to a lamp socket, more particularly to an insulation displacement connector (IDC) wedge base angled lamp socket for a wedge based lamp used in a lighting module of a motor vehicle. This angled lamp socket of the present invention is particularly useful in front and rear automobile directional and safety lighting.

BACKGROUND ART

The need for a lamp socket wherein the horizontal axis of the lamp inserted therein extends in one direction and the terminals of the lamp socket extend in another direction and at an angle thereto is well known. Such a lamp socket is herein referred to as an angled lamp socket. One such angled lamp socket is referred to in the lamp industry as a right angle lamp socket. In such a lamp socket, the horizontal axis of the lamp and the terminals of the lamp socket are orientated at 90° relative to each other.

It is presently known to provide an angled lamp socket that is satisfactory for use in motor vehicle applications. Examples of such angled lamp sockets are illustrated in U.S. Pat. Nos. 5,197,187 and 5,411,407 (these patents are commonly owned with the instant application and are incorporated herein by reference). Another example is illustrated by Application Ser. No. 09/260,253 filed Mar. 2, 1999, (this application is presently assigned to the assignee of the present invention and is hereby incorporated by reference). However, such lamp sockets with wire leads require that the wires be stripped and terminals be crimped to them. These wires with crimped terminals are then either separately or together, as part of a connector, plugged into the terminals which contact the lamp. This requires additional terminals and an additional set of mating interfaces, resulting in both increased cost and decreased reliability.

DISCLOSURE OF THE INVENTION

It is an object of the present invention to obviate the disadvantages of the prior art.

It is an object of the present invention to provide an improved angled lamp socket.

It is an object of the present invention to provide an angled lamp socket that is less costly to fabricate than those heretofore provided.

It is an object of the invention to make a more reliable angled lamp socket by effectively connecting the socket wire leads directly to the same terminals that actually make contact with the lamp.

It is an object of the present invention to provide a more reliable angled lamp socket by using IDC contacts to engage the lead wires thereby eliminating the need for welding in the socket housing.

It is a further object of the present invention to provide an angled lamp socket having improved life expectancy.

It is another object of the present invention to provide an improved method for assembling the angled lamp socket of the present invention.

This invention achieves these and other objectives by providing an angled lamp socket that comprises a body having a housing attached thereto. At least one lamp retaining member is provided within the body and is structured to retain a lamp that has a longitudinal lamp axis, such that the lamp axis will extend in a first direction when the lamp is inserted into the body. A plurality of "U" shaped IDC contacts is provided such that at least a portion of each is in the socket body with a portion extending beyond the bottom of the body. A socket housing disc, containing a plurality of slits to receive the portion of the IDC terminals protruding below the socket body, will be placed into the housing. The disc will contain a plurality of small finger-like projections on the rear of the disc that will place a normal force on wire leads placed into the housing. The disc will also contain a center post to help secure the disc in the housing and a plurality of holes through which molded projections from the bottom of the body will go to place stain relief on the wires. The housing contains a plurality of holes through which wires will be inserted. The floor of the housing will contain a plurality of grooves in which the wires will sit as they are inserted into the housing. These wires will be inserted in a second direction which will be at an angle to the first direction. Each wire will be fed through a hole into the housing where it will be held in place by the finger-like projections of the housing disc to prevent easy removal of the wires. The IDC terminals, securely located in the body and guided by the slits in the housing disc, terminate the wires at the same time that molded projections from the rear of the socket body put strain relief on the wires. A method for assembling an angled lamp socket is also provided.

BRIEF DESCRIPTION OF THE DRAWINGS

This invention may be clearly understood by reference to the attached drawings in that like reference numerals designate like parts and in that.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
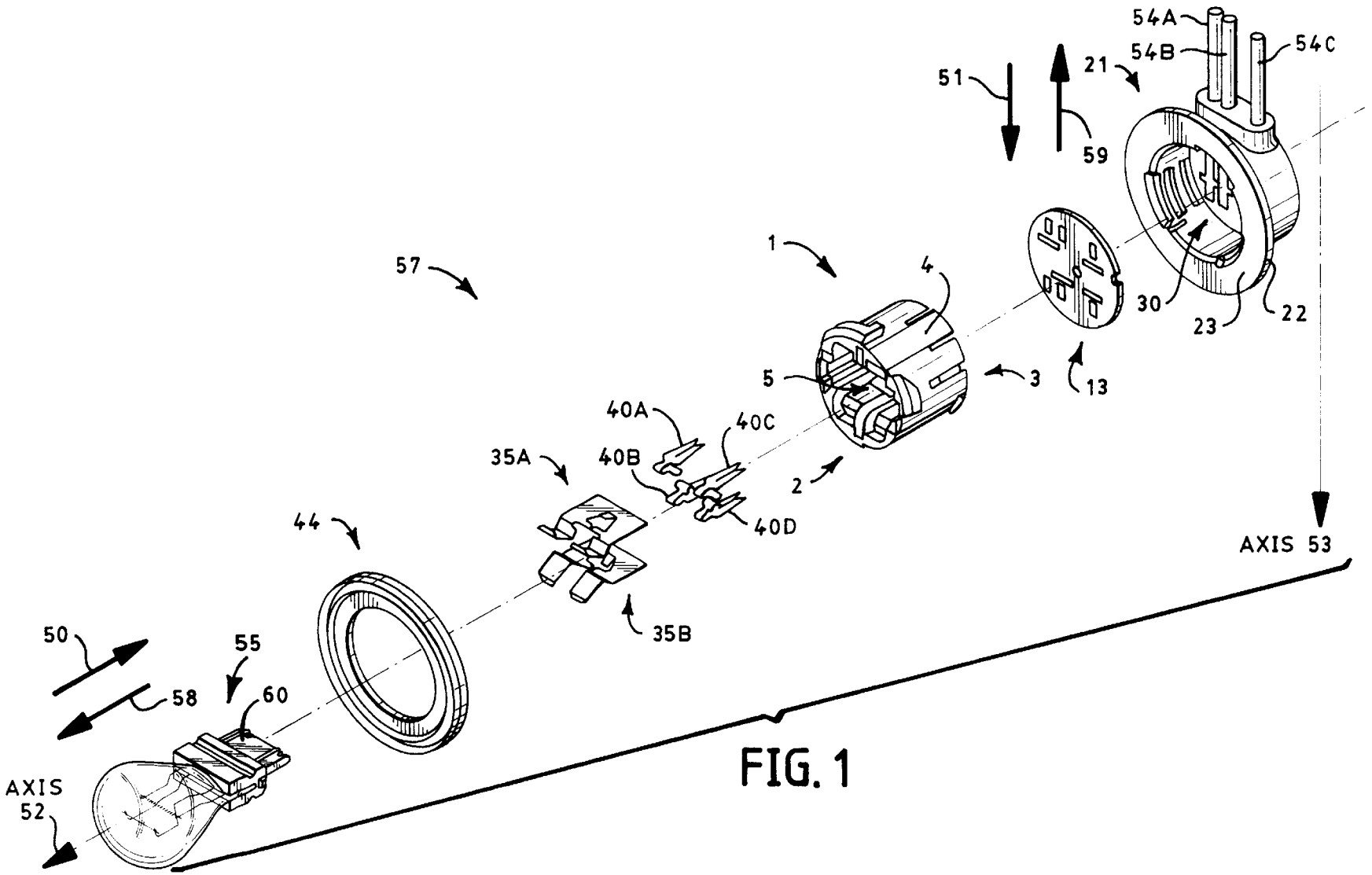
FIG. 1 is an exploded view of an angled lamp socket in accordance with one embodiment of the present invention with a lamp shown but not attached.

The embodiment of this invention that is illustrated in the drawings is particularly suited for achieving the objects of this invention. FIG. 1 illustrates a lamp socket 57 embodying the present invention. Lamp socket 57 provides a three piece insulator that is in the form of first, second and third slidably engaging components including a body 1, a housing disc 13, and a housing 21. As will be apparent herein, the three-piece insulator simplifies design and assembly of the lamp socket. The body component includes a body cavity 5 that extends in a direction 50 of axis 52.

The housing disc 13 (FIG. 3) contains a plurality of slits 16A, B, C and D. These slits receive the bottom portion 42 of the IDC contacts 40A, B, C and D (shown in FIG. 9) guiding them to a position just above the wire leads 54A, B and C at an approximate distance of 5.3 mm. The housing 21 includes a cavity 30 that opens in direction 58 of axis 52 and a plurality of holes 29A, B and C, the holes extending in the direction 59 of axis 53. The axis 52 extends at an angle to the axis 53. In the preferred embodiment illustrated in FIG. 7, the angle is 90°, and the angled lamp socket is a right angle lamp socket. The body and the housing disc are connected to the housing as described hereinafter.

The lamp socket 57 includes two lamp-retaining members in the form of a first resilient retention member 35A and an opposite second resilient retention member 35B. In a preferred embodiment, the resilient retention members are metal, although other materials may be used. Retention members 35A and 35B are structured and arranged for insertion into the body cavity 5 to retain a wedge-like base 60 of a lamp 55, such as a conventional S8 wedge base lamp, so that the lamp longitudinal axis 52 extends in the first direction 50 when the lamp is inserted in the body cavity.

The lamp socket 57 includes a plurality of IDC contacts 40A, B, C and D, in the body cavity 5. In a preferred embodiment each IDC contact is "U" shaped, although other shapes may be used. Each IDC contact 40 includes a top end 41 and a bottom end 42. The top end 41 faces the front end 2 of the body 1 and is adapted to engage a respective lead 56 of lamp 55. The bottom end 42 extends out of the body 1 at the rear end 3 of said body and is adapted to terminate a wire lead.

The lamp socket includes wire leads 54A, B and C, which are inserted into the holes 29 A, B and C in the housing 21. Each wire lead is inserted into a hole in the housing and is guided by a groove 24 in the floor of the housing to its final position.

Figure 4:
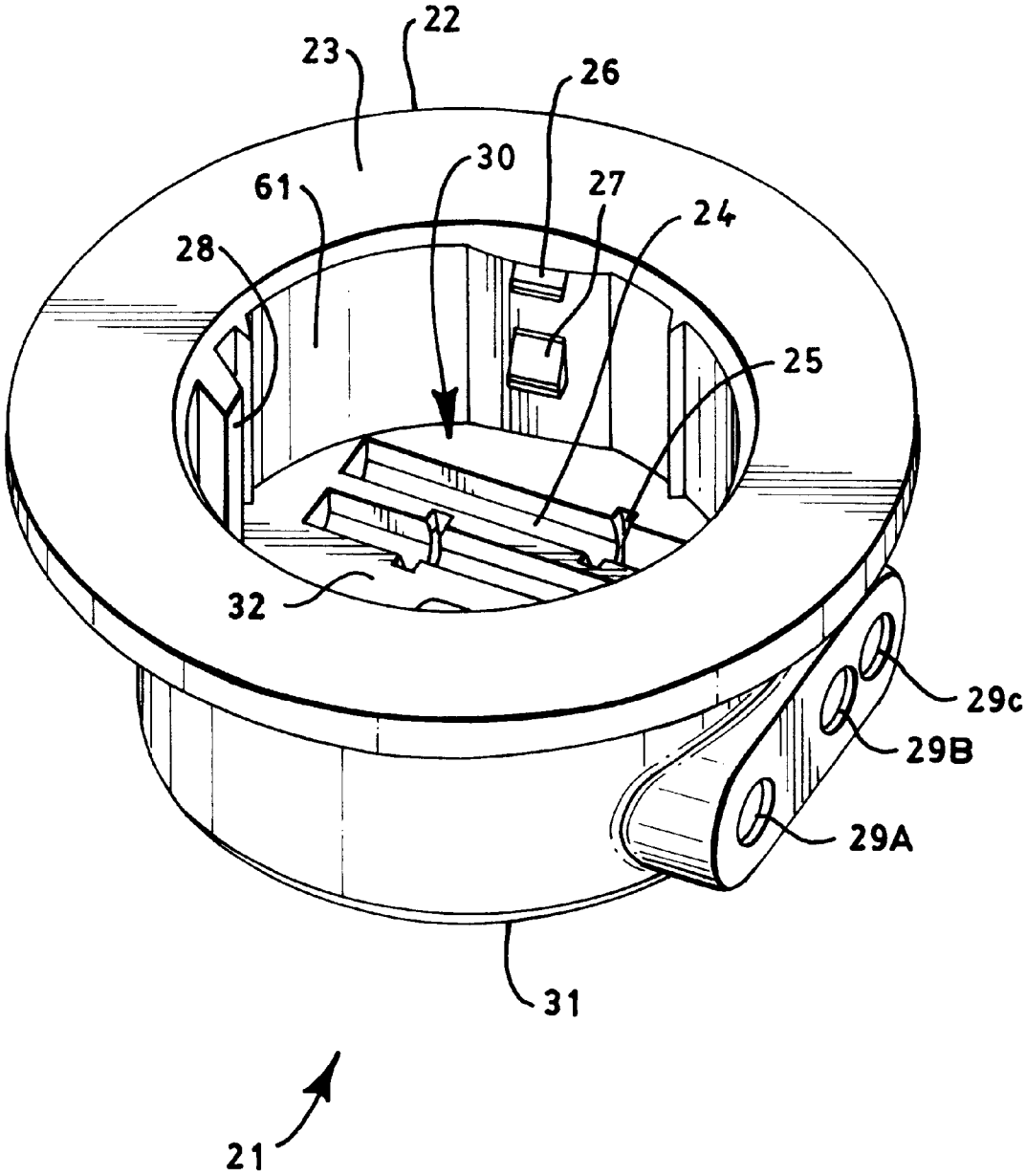
FIG. 4 is a top perspective view of the housing.

In a preferred embodiment, the housing disc 13 is snapped into the housing cavity 30 in the first direction. The body 1, containing the lamp retention members 35A and 35B and the IDC contacts 40A, B, C and D, is snapped into the housing cavity 30 at a position where the bottom portion 42 of the IDC contacts 40 is approximately 5.3 mm from the termination point of the wire leads 54. Wire leads 54A, B and C, are inserted into the holes in the housing in the second direction. The wire leads deflect up finger-like projections (not shown) on the rear of the housing disc 13, these finger-like projections exerting a normal force on the wire leads 54A, B and C, to prevent easy removal of said wire leads. A force is exerted on the front of the body 1 in the first direction. As the body snaps down into the housing cavity 30, the bottom portion of the IDC contacts 42A, B, C and D, pass through the slits 16A, B, C and D, in the housing disc 13 and terminate the wire leads 54A, B and C, providing an electrical connection. As illustrated in FIG. 4, the bottom portion of the IDC contacts engage detents 25 in the floor 32 of the housing 21 upon termination of the wire leads 54. Simultaneously, molded protrusions 7A, B and C, on the rear of the body 1 pass through holes 17A, B and C, in the housing disc 13 and engage the wire leads 54A, B and C, providing strain relief on said wire leads.

Figure 2B:
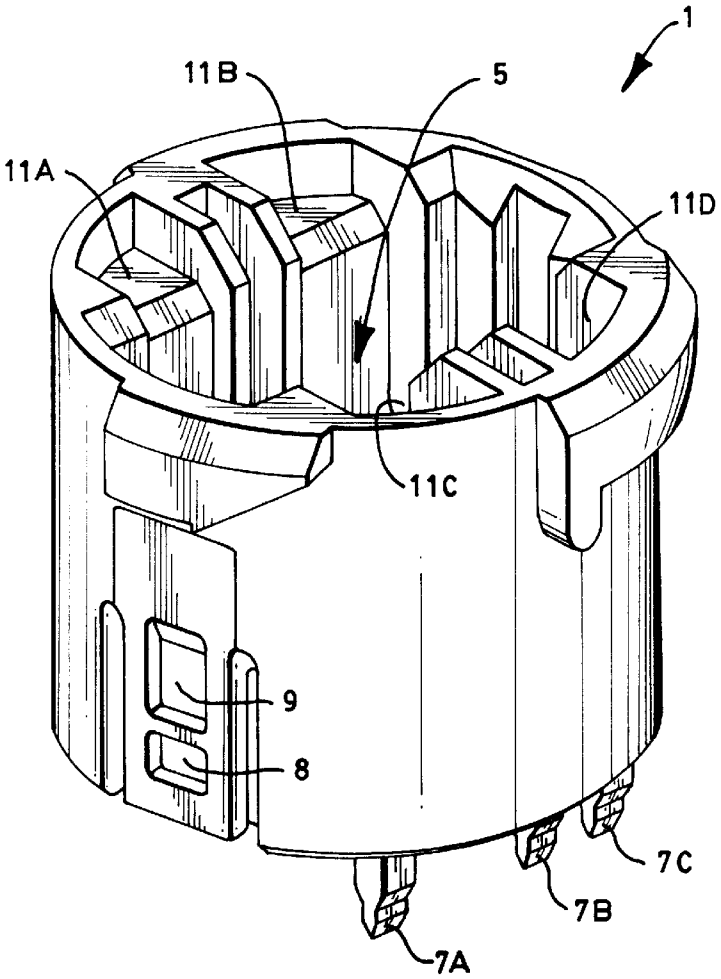
FIG. 2B is a perspective view of the body of the lamp socket in top plan.
Figure 2A:
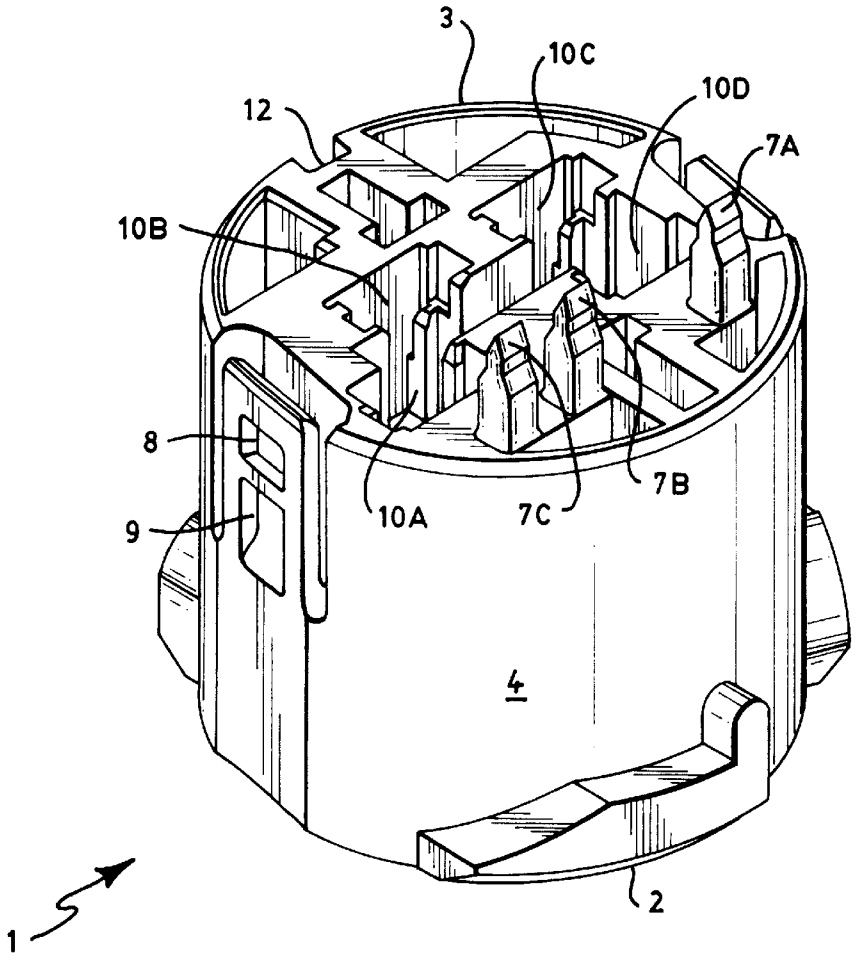
FIG. 2A is a perspective view of the body of the lamp socket in bottom plan.

FIG. 2 shows the body 1 with rear portion 3 having a plurality of molded projections extending in direction 50 of axis 52. Apertures 10A, B, C and D, on the rear 3 of the body 1 allow the bottom 42 of each IDC contact member 40A, B, C and D, to extend below the body. A notch 12 on one side of the body 1 contacts a vertical rib 28 on the interior wall surface 61 of the housing cavity 30 helping guide the body into its proper position in the housing cavity. Detents 8 and 9 on the outside surface 4 of the body 1 engage ribs 26 and 27 on the interior surface of the housing cavity 21 securing the body in said housing. Slots 11A, B, C and D, in the front of the body cavity 5 receive the lamp retention members 35A and 35B securing them in the body cavity.

Figure 3:
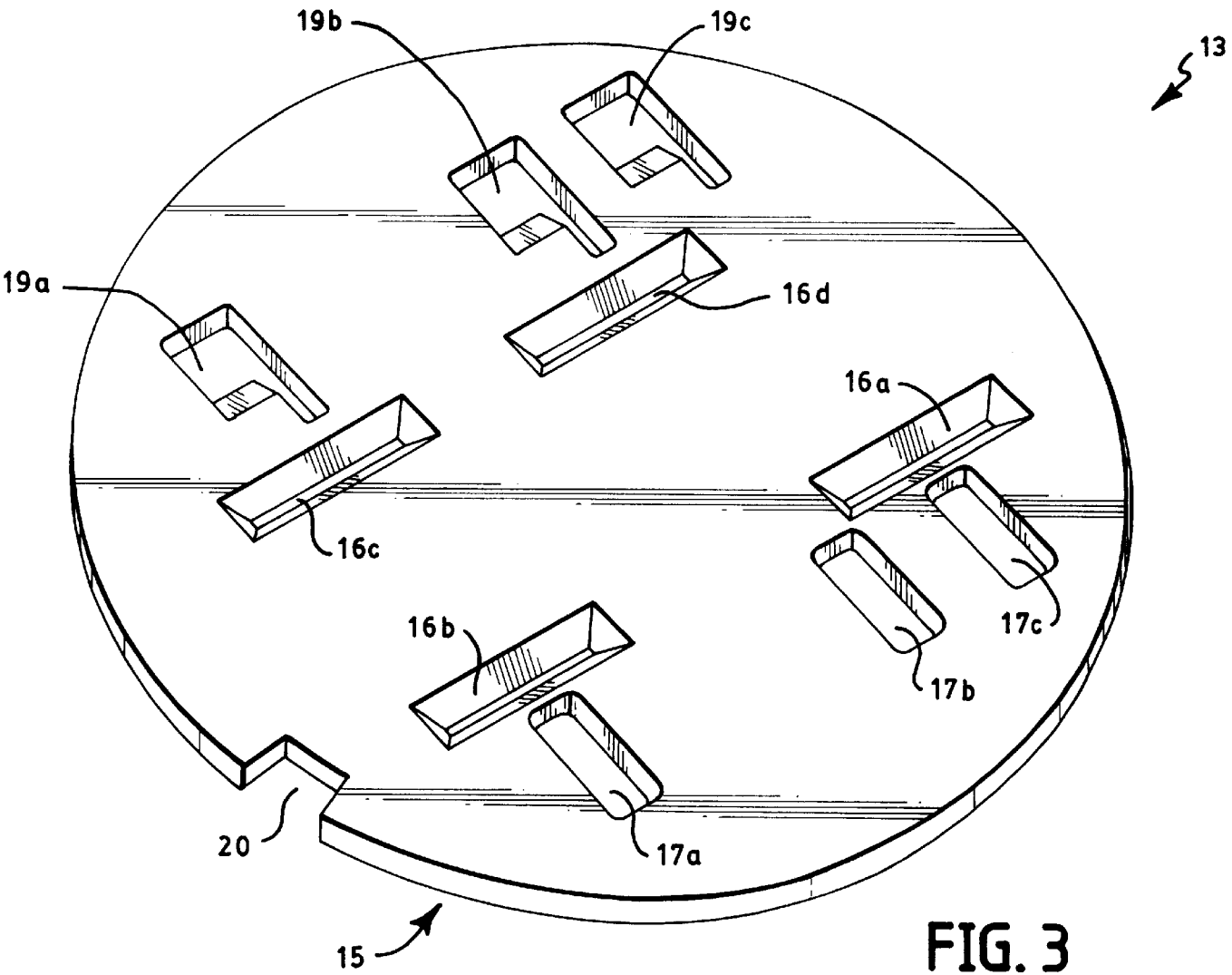
FIG. 3 is a top perspective view of the housing disc.

FIG. 3 shows the housing disc 13 with slits 16A, B, C and D to receive the bottom portion 42 of the IDC contact members 40. Holes 29A, B and C, (see FIG. 4) receive the molded projections 7A, B and C, extending from the rear 3 of the body 1 and the top view of the finger-like projections (not shown) that extend from the rear 15 of the housing disc 13, the finger-like projections providing a normal force on the wire leads 54A, B and C, inserted into the housing thereby preventing easy removal of said wire leads. A notch 20 on the side of the housing disc contacts a vertical rib 28 on the inside surface of the housing cavity 30 helping to guide the disc into position. The center post 18 (see FIG. 5) on the rear of the housing disc engages a detent 34 (see FIG. 5) in the floor of the housing 21. The disc snaps into position engaging rib 27 on the inside surface of said housing.

FIG. 4 shows the housing 21 with a cavity 30 extending in direction 58 of axis 52 and a plurality of holes 29A, B, and C extending in direction 59 of axis 53 through which wire leads 54A, B and C, are inserted. The wire leads 54A, B, and C, are guided into place by grooves 24 in the floor of the housing 21. Vertical rib 28 aligns with the notch 20 on the housing disc 13 as it is snapped into the housing cavity 30. Rib 27 (not shown) holds the housing disc in place. In the initial position, rib 26 engages detent 8 on the body's outside surface 4 so that the IDC contact members 40A, B, C and D, are positioned just in the slits 16A, B, C and D, of the housing disc 13 at a position approximately 5.3 mm from the wire leads 54A, B and C. The surface 23 of the flange 22 receives the annular seal 44 and the inside surface of the flange 49 engages the outside surface 4 of the body 1.

Figure 5:
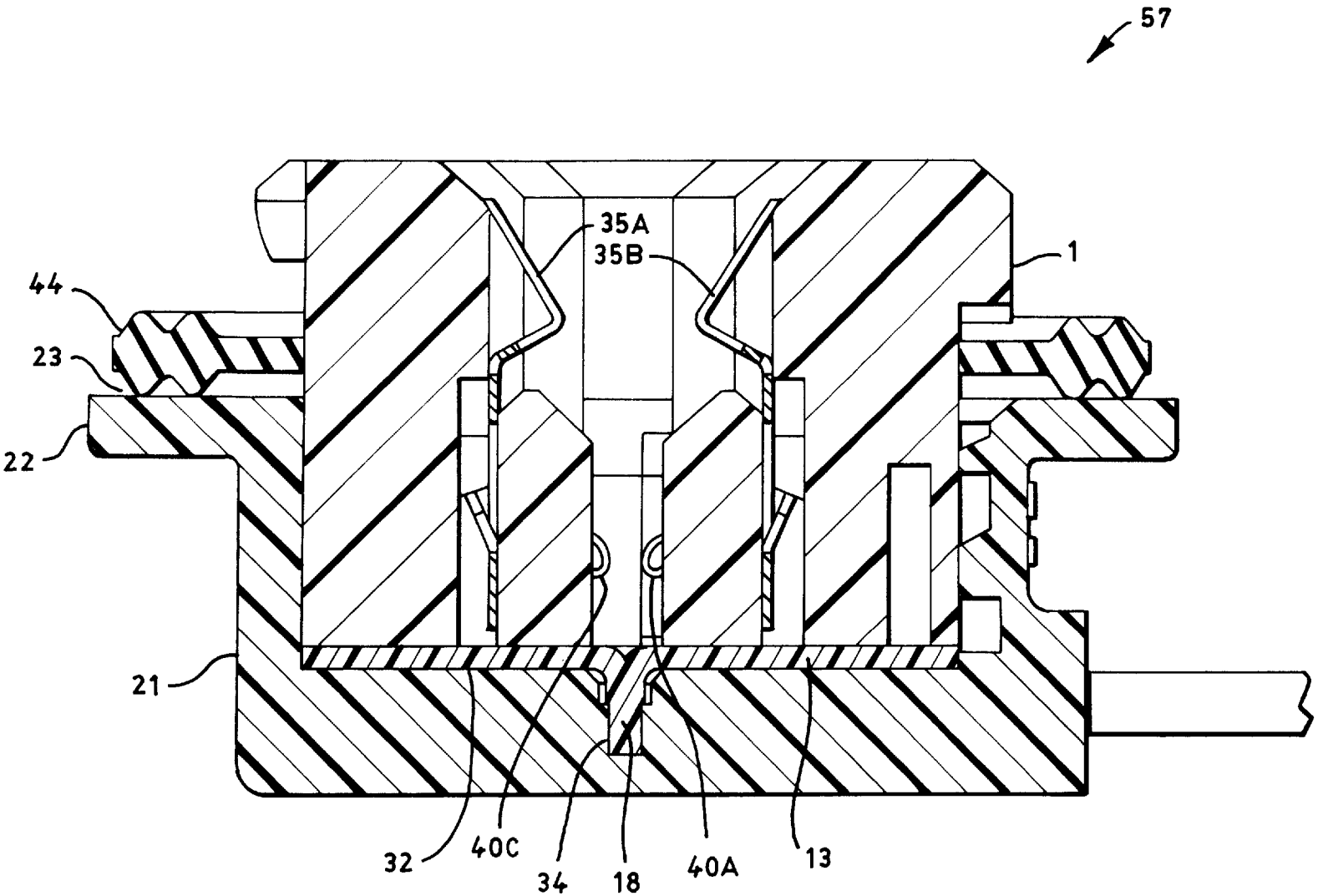
FIG. 5 is a cross section of the completed lamp socket showing the housing disc center post engagement of the housing.

FIG. 5 shows a cross section of the completed lamp socket 57. The body 1, containing lamp retention members 35A and 35B, is snapped into the housing 21. The housing disc 13 has center post 18 which engages a detent 34 in the floor 32 of the housing 21. The annular seal 44 engages the front surface 23 of the flange 22. IDC contacts 40A, and C, engage the lamp terminals (not shown) creating an electrical connection.

Figure 6:
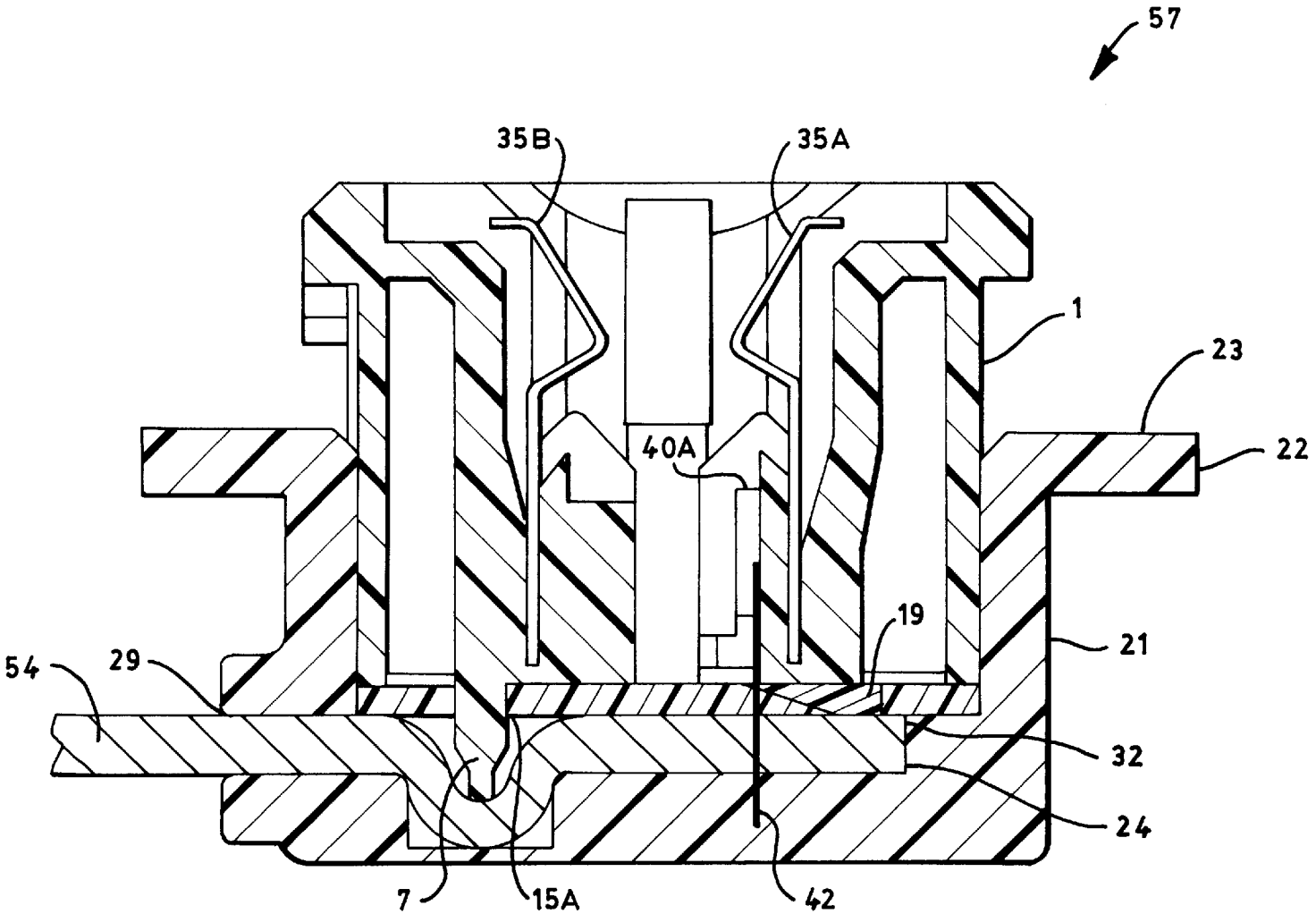
FIG. 6 is another cross section of the completed invention showing the strain relief placed on the wire leads by the molded plastic protrusion on the rear of the body.

FIG. 6 shows a cross section of the completed lamp socket 57. A wire lead 54 is placed into a hole 29 of the housing 21 at the second direction. The wire lead is guided by a groove 24 in the floor 32 of the housing deflecting up a finger-like projection 19 on the rear of the housing disc 13 preventing the wire lead from being easily removed.

A force is exerted on the body 1 in the first direction. The bottom portion 42 of an IDC contact 40A passes through one of the slits 16 in the housing disc 13 and terminates the wire lead 54 while a molded projection 7 from the rear of the body 1 passes through a hole 17 in the housing disc 13 and engages the wire lead 54 providing strain relief. As a result of the force applied to the front of the body 1, ribs 26 and 27 located on the inside surface 61 of the housing 21, engage notches 8 and 9, located on the outside surface 4 of the body 1, securing the body inside the housing.

Figure 7:
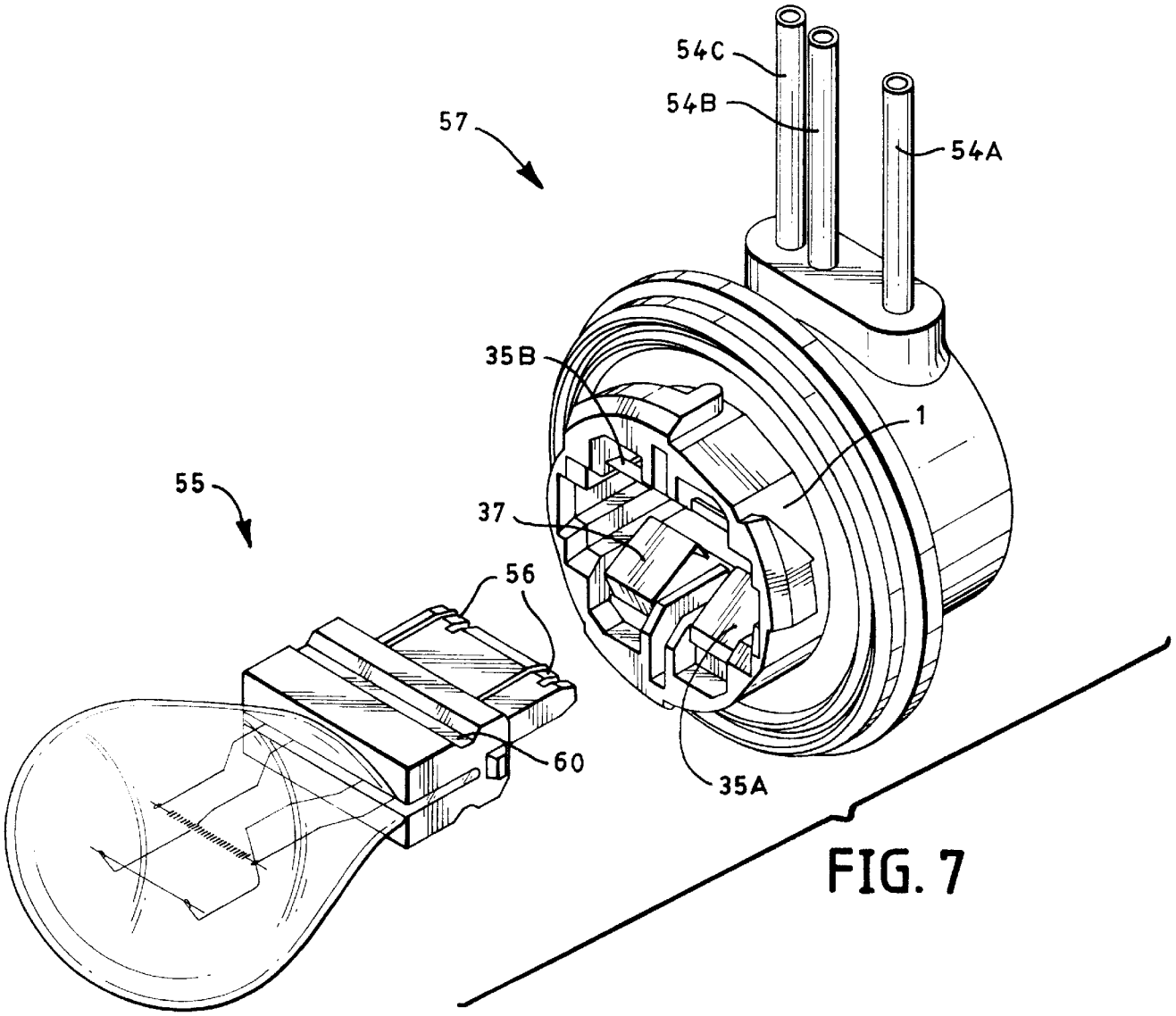
FIG. 7 is a front view of the completed lamp socket and non-attached lamp.

FIG. 7 shows a completed angled lamp socket 57 with a lamp 55 not attached. In a preferred embodiment the lamp 55 is inserted into the lamp socket body 1 in a first direction and is held in place by lamp retention members 35A and 35B. Angled portions 37 of the lamp retention members 35 engage the lamp base 60 thereby securing the lamp in the body cavity 5. Wire leads 54A, B and C, extend from the housing in the second direction thereby creating an angled lamp socket. The lamp terminals 56 contact the top portion 41 of the IDC contacts creating an electrical connection between the lamp and the IDC contacts. The bottom portion 42 of the IDC contacts terminate the wire leads 54A, B and C, as shown in FIG. 6, providing an electrical connection between the IDC contacts and the wire lead. This allows the lamp terminals 56 to be electrically connected to the same IDC contacts 40A, B, C and D, that terminate the wire leads 54A, B and C, eliminating welding in the housing and the need for additional sets of contact members.

Figure 8:
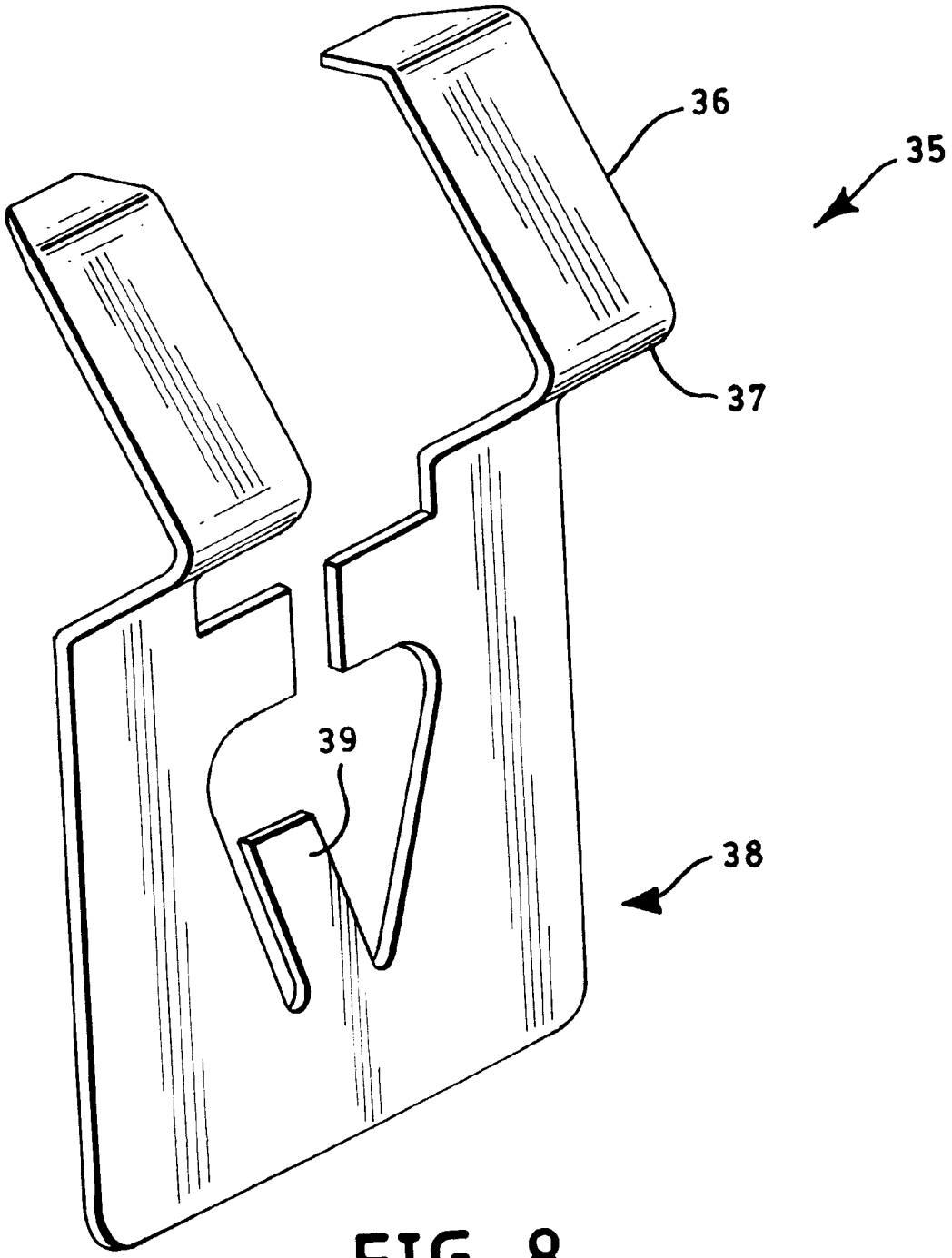
FIG. 8 is a perspective view of a lamp retainer clip.

FIG. 8 shows a lamp retainer clip 35 with a bottom portion 38 and a small finger projection 39 which holds the retainer clip in the body cavity 5 when said small finger projection 39 contacts a detent in the body cavity. Top portions 36 contain an angled bend 37 which, when placed in the body cavity 5 secure the lamp 55.

Figure 9:
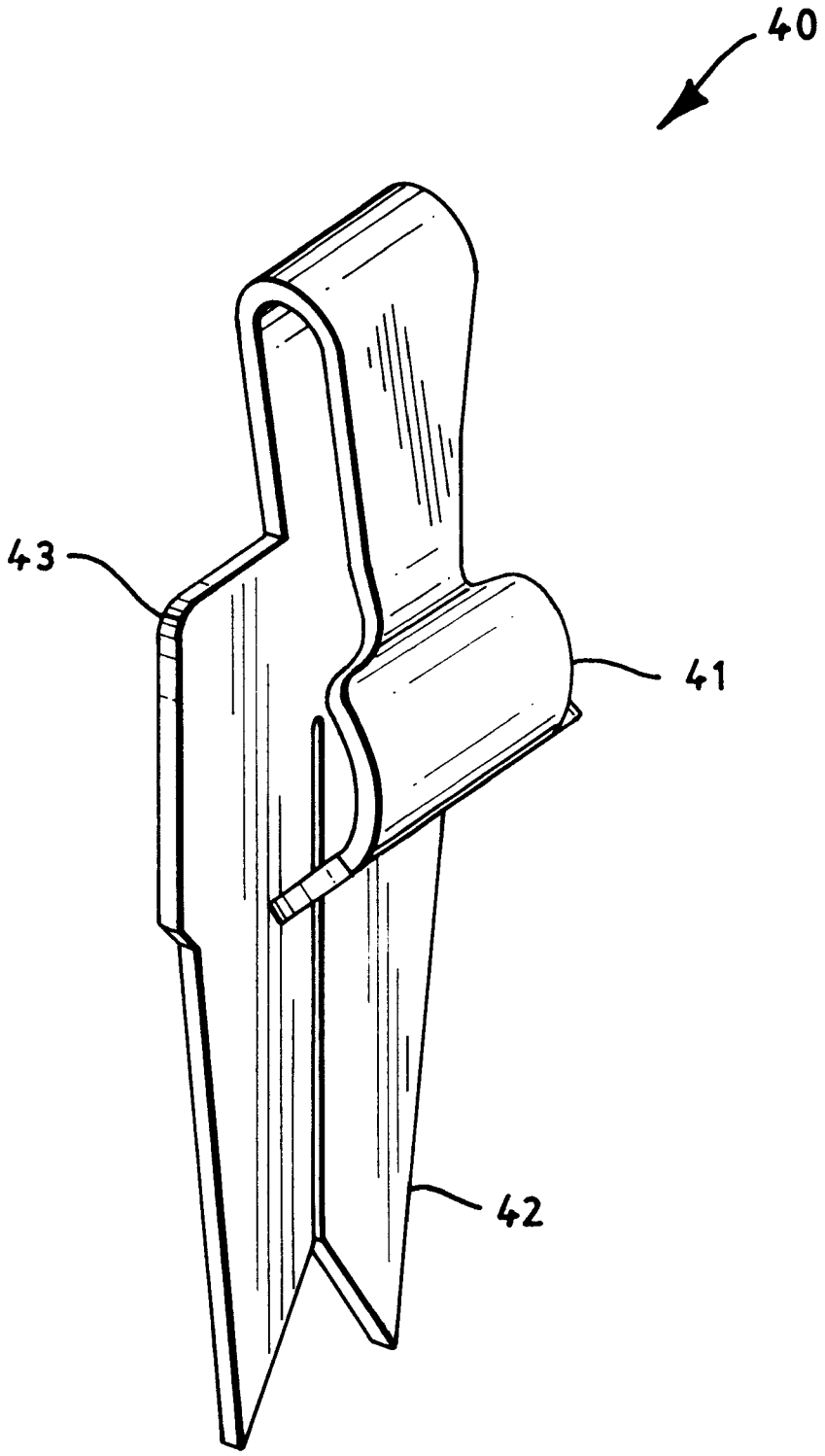
FIG. 9 is a perspective view of an IDC contact.

FIG. 9 shows a U-shaped IDC contact 40. The top portion 41 engages the leads 56 of the lamp 55 thereby creating an electrical connection. The IDC contact also contains shoulders 43 which engage portions of the body cavity 5 to keep the IDC contact in place. The bottom portion 42 of the IDC contact 40 is shaped so as to allow it to terminate a wire lead 54 by cutting through the insulation and engaging the copper wire thereby creating an electrical connection.

Thus there is provided an angled lamp socket that is economical to fabricate. The need for welding, with its concomitant contamination, is eliminated. Further, the number of contacts is minimized by utilizing the socket wire-lead contact as a direct connection to the lamp.

While there have been shown and described what are at present considered the preferred embodiments of the invention, it will be apparent to those skilled in the art that various changes and modifications can be made herein without departing from the scope of the invention as defined by the appended claims.

What is claimed is:

1. An angled lamp socket, comprising;

a body having a body cavity extending in a first direction of a first axis from a front end of said body to a rear end of said body;

a housing having a housing cavity for receiving said body extending in said first direction and a plurality of holes extending through said housing in a second direction such that said second direction is at an angle to said first direction, said housing cavity having a floor including a detent;

a housing disc positioned in said housing cavity between said floor and said body, said housing disc having a plurality of slits, each of said slits being capable of receiving a bottom portion of one IDC contact, said housing disc having a molded post on a rear surface thereof for engaging said detent;

at least one lamp retaining member including at least a portion of which is in said body cavity, said lamp retaining member being structured and arranged to retain a lamp having a longitudinal lamp axis to be inserted in said body cavity at said front end of said body cavity such that said longitudinal lamp axis of said lamp will extend in said first direction when said lamp is inserted in said body cavity; and a plurality of IDC contacts positioned in said body such that a first portion of each IDC contact is in said body cavity and a second portion of each IDC contact extends beyond the rear end of said body and through a slit of said housing disc and is capable of terminating a wire lead.

2. The angled lamp socket of claim 1 wherein said rear of said housing disc further comprises plastic molded finger-like projections capable of placing a normal force on said wire lead.

3. A method for assembling an angled lamp socket, said angled lamp socket comprising a body containing a body cavity, a housing disc, and a housing containing a housing cavity and being of the type wherein a longitudinal lamp axis of a lamp to be inserted into a front end of said angled lamp socket will extend at an angle to a plurality of wire leads placed into said housing, comprising the steps of:

inserting said housing disc into said housing cavity such that said housing disc snaps into said housing with a molded post on a rear surface of said housing disc engaging a detent formed in a floor of said housing cavity said housing disc containing a plurality of slits;

inserting a plurality of IDC contacts into said body cavity such that a contact lead surface of each IDC contact extends away from a front of said body and a bottom portion of each IDC contact extends beyond a rear end of said body; and inserting said body into said housing cavity whereby said bottom portion of each of said IDC contacts penetrates an appropriate one of said slits and each bottom portion of each IDC contact terminates a wire lead.

* * * * *